US008632029B1

(12) United States Patent
Cato

(10) Patent No.: US 8,632,029 B1
(45) Date of Patent: Jan. 21, 2014

(54) MATERIAL CRUSHER

(76) Inventor: James Cato, Brenham, TX (US)

( * ) Notice: Subject to any disclaimer, the term of this patent is extended or adjusted under 35 U.S.C. 154(b) by 351 days.

(21) Appl. No.: 13/106,674

(22) Filed: May 12, 2011

Related U.S. Application Data

(60) Provisional application No. 61/333,819, filed on May 12, 2010.

(51) Int. Cl.
*B02C 19/00* (2006.01)

(52) U.S. Cl.
USPC ..... 241/275

(58) Field of Classification Search
USPC ..... 241/275
See application file for complete search history.

(56) References Cited

U.S. PATENT DOCUMENTS

| | | | | |
|---|---|---|---|---|
| 265,398 | A | 10/1882 | Esmond et al. | |
| 1,500,090 | A | 7/1924 | Sturtevant | |
| 1,639,678 | A | 8/1927 | Woodward | |
| 3,540,667 | A * | 11/1970 | Parker | 241/275 |
| 4,003,831 | A | 1/1977 | Tishkov et al. | |
| 4,642,180 | A | 2/1987 | Kaufman | |
| 4,690,341 | A * | 9/1987 | Hise et al. | 241/275 |
| 5,232,098 | A | 8/1993 | St-Pierre et al. | |
| 5,341,939 | A | 8/1994 | Aitchison et al. | |
| 6,575,304 | B2 | 6/2003 | Cudahy | |
| 2009/0206011 | A1 | 8/2009 | Cudahy | |
| 2010/0038291 | A1 | 2/2010 | Sauser | |

* cited by examiner

*Primary Examiner* — Mark Rosenbaum
(74) *Attorney, Agent, or Firm* — Buskop Law Group, PC; Wendy Buskop

(57) ABSTRACT

A material crusher system including a body, a lid, an outlet, and a feed tube disposed through the lid for receiving particulate. The system can include a centrifugal assembly within the body for receiving and crushing the particulate. A motor can be connected to the centrifugal assembly for controlling a rotating plate. A variable frequency drive can be connected to the motor for optimizing a rotation speed of the rotating plate, thereby preventing over-crushing of the particulate. The system can include a plurality of anvil holders disposed around an anvil ring with an anvil in each anvil holder. Each anvil can be impacted by the particulate and a downdraft can carry the particulate from the anvil to the outlet. The system can include a gas purge system for pressurizing a shaft bearing on the motor, enabling for continuous use of the ultrafine material crusher system.

19 Claims, 10 Drawing Sheets

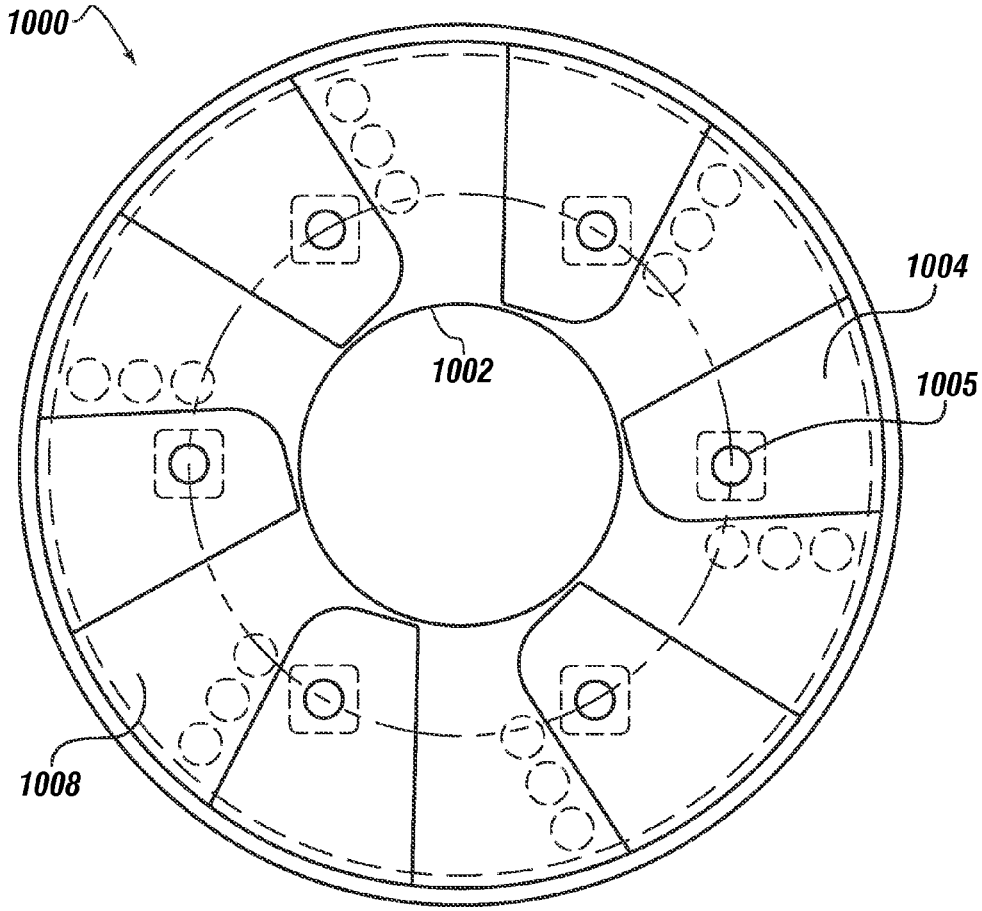
FIGURE 10
FIGURE 11
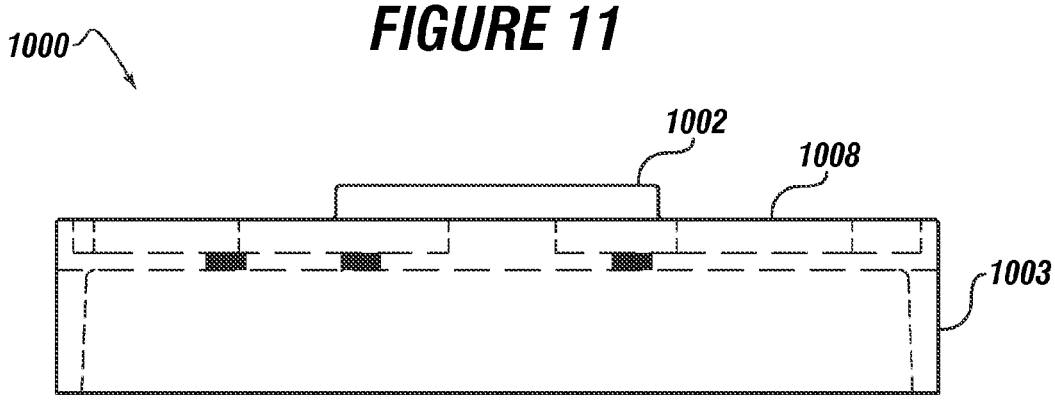

MATERIAL CRUSHER

CROSS REFERENCE TO RELATED APPLICATIONS

This application claims priority to and the benefit of co-pending U.S. Provisional Patent Application Ser. No. 61/333,819 filed May 12, 2010, entitled "Material Crusher". This reference is incorporated herein in its entirety.

FIELD

The present embodiments generally relate to an ultrafine material crusher system for crushing materials.

BACKGROUND

A need exists for a system capable of crushing materials to produce a fine to ultrafine particulate without over-crushing the material and producing too much waste.

A further need exists for a system capable of recovering valuable materials as fine to ultrafine particulates from a bulk particulate.

A need exists for a system that can produce a fine cubical product.

A need exists for a system that is capable of handling hard, extremely hard and friable materials.

A need exists for a system that can also produce a predictable output depending on a size and rate of feed.

A need exists for a system that is able to maximize a size and rate of production.

A need exists for a system that uses less energy than current crushing systems.

The present embodiments meet these needs.

BRIEF DESCRIPTION OF THE DRAWINGS

The detailed description will be better understood in conjunction with the accompanying drawings as follows:

FIG. 10 depicts another embodiment of a table according to one or more embodiments.

FIG. 11 depicts an elevation view of the table of FIG. 10.

Figure 1:
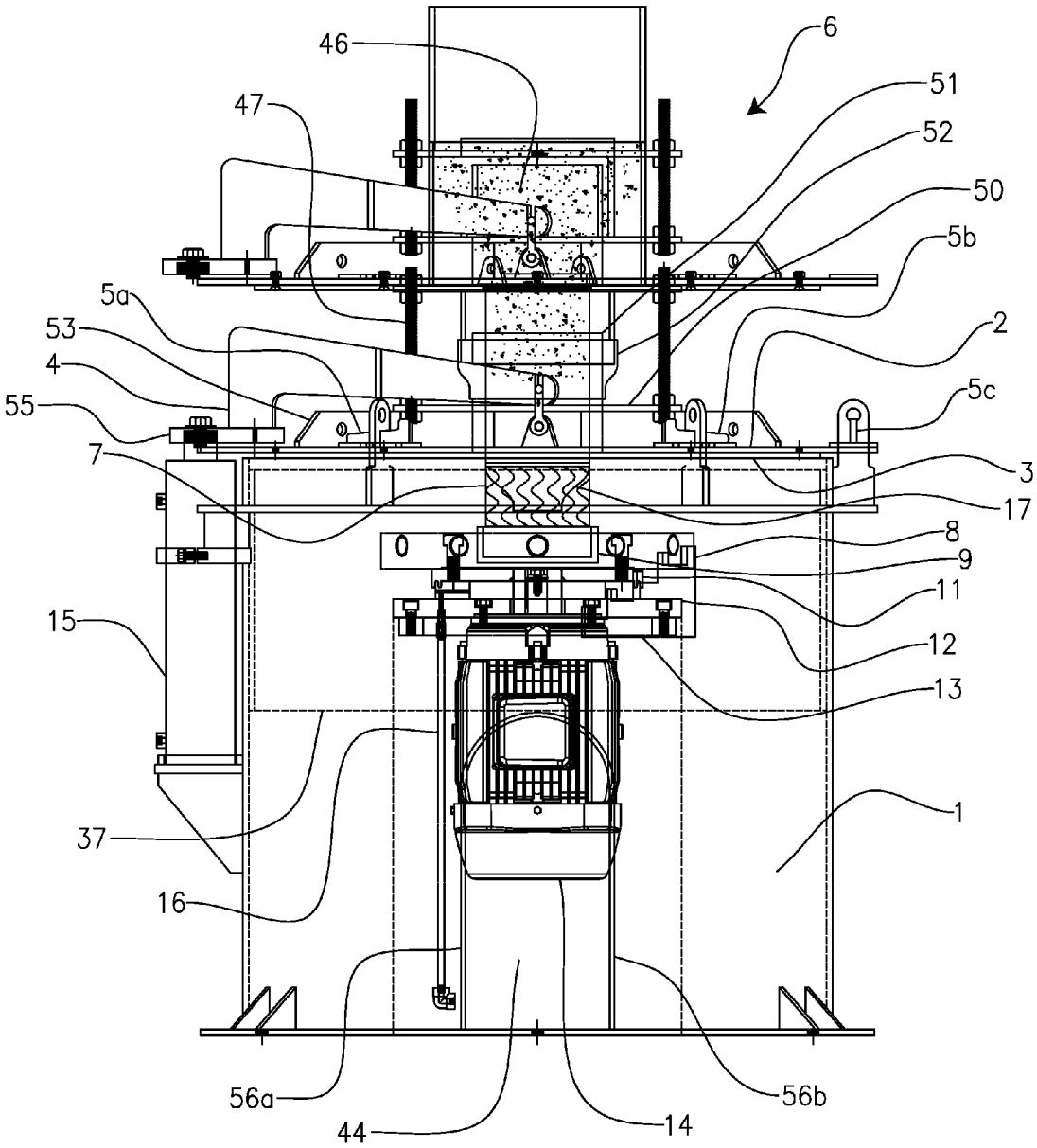
FIG. 1 depicts a side view of an ultrafine material crusher system according to one or more embodiments.

The present embodiments are detailed below with reference to the listed Figures.

DETAILED DESCRIPTION OF THE EMBODIMENTS

Before explaining the present system in detail, it is to be understood that the system is not limited to the particular embodiments and that it can be practiced or carried out in various ways.

The present embodiments generally relate to an ultrafine material crusher system.

Embodiments of the ultrafine material crusher system can be used to produce a fine to ultrafine cubical product. The ultrafine material crusher system can be used to crush glass, metals, catalysts, rocks, mineral and non-mineral materials.

For example, the ultrafine material crusher system can be used for recycling cullet glass to form glass bead reflective media that can be compounded in paints used to mark roadways and light reflective signage; for recycling bottles, such as beer bottles; to form a blasting media as well as an ultrafine material to be used as an inert filler for carpet backing; or for crushing magnetite to an ultrafine consistency to be used to clean up high sulfur coal for use in power plants.

Embodiments of the ultrafine material crusher system can handle hard, extremely hard, and friable materials.

Embodiments of the ultrafine material crusher system can produce a predictable output which can depend on a size of the particulate feed and a rate of the particulate feed.

Embodiments of the ultrafine material crusher system can be used to maximize a size of fine particulate produced and to maximize a rate of production of the fine to ultrafine particulate without over-crushing the particulate.

Embodiments of the ultrafine material crusher system can reduce the amount of over-crushed waste product.

For example, garnet can sell for $500.00 per ton. Also, platinum can cost $1,600.00 per ounce. Both garnet and platinum can be recovered using the ultrafine material crusher system. Over-crushing of such expensive materials can be very costly and counterproductive and can be avoided using the ultrafine material crusher system.

Embodiments of the ultrafine material crusher system can have a low horsepower (hp) requirement, such as from about ¾ hp to about 2 hp per ton of particulate crushed per hour of thru-put of particulate.

Embodiments of the ultrafine material crusher system can produce low amounts of heat and can therefore make the system suitable for the crushing of material that is heat sensitive.

Embodiments of the ultrafine material crusher system can receive hard to process waste products and convert them into usable products such as "green products".

The system can be used to receive a particulate through a feed tube and to produce a fine to ultrafine particulate therefrom. The received particulate can be generally dry and granular.

The ultrafine material crusher system can include a body, or a crusher body. The body can have a lid which can be an openable lid. The body can have an outlet. The outlet can be in fluid communication with an inside of the body.

In one or more embodiments the body can have a forty eight inch diameter. The body can have a capacity capable of crushing about one hundred tons of material per hour.

The ultrafine material crusher system can include a feed tube. The feed tube can be disposed through the lid and can be in fluid communication with an inside of the body. A position of the feed tube in the openable lid can be adjustable.

In one or more embodiments, the feed tube can be attached or connected to the body with a feed tube adjustment assembly. The feed tube adjustment assembly can be an upper feed tube support plate and feed chute connected to a lower anchor plate by way of adjustable threaded rods to increase or decrease the length of the penetration of the feed tube into the crusher body.

In operation, particulate can be inserted into the feed tube. The feed tube can receive the particulate and can form a particulate flow of the particulate into the inside of the body.

The lid can include an inlet sleeve that can surround the feed tube for providing dust control. The lid can include a boot that can be disposed around the inlet sleeve for providing further dust control.

The lid can include an anchor plate that can surround the inlet sleeve penetration in the lid assembly as well as support the adjustable height feed tube support plate and feed chute.

The lid can include a plurality of radial support bars that can project from the inlet sleeve for providing structural strength to the lid to support the feed chute and related inlet material weight and to prevent the lid from separating from the body while affixed by wedges during operation. The plurality of radial support bars can provide strength to the openable lid to contain any flying debris and metal within an inside of the crusher body upon the occurrence of any mechanical failure of the system.

The lid can include an abrasion resistant lid liner that can line the lid.

The ultrafine material crusher system can include a centrifugal assembly disposed within the body. The centrifugal assembly can be a rotating centrifugal multiport assembly. The centrifugal assembly can be in fluid communication with the feed tube for receiving the particulate.

The centrifugal assembly can include a rotating plate. The rotating plate can be a circular rotating plate and can have a perimeter or a plate perimeter.

The centrifugal assembly can include at least one port or a plurality of ports. In one or more embodiments, the ports can be equidistantly disposed along the perimeter. The ports can be drilled into the rotating plate.

The centrifugal assembly can include a well. The particulate can flow into the well.

The well can be disposed on the rotating plate for receiving the particulate from the feed tube.

In one or more embodiments, the well can be centrally disposed on the rotating plate. The particulate can be received by the well from the feed tube at an angle. In one or more embodiments, the angle at which the well receives the particulate can be from about eighty degrees to about one hundred degrees.

The well can be integrally formed in the rotating plate. The well can be formed of a material different from the material of which the rotating plate is formed.

In one or more embodiments, the well can be formed of ceramic, boron, boron nitrides, tungsten, tungsten carbides, alumina, zirconium, silicon carbide, other carbides, or other metals.

A customized well can be used such that the customized well is formed of a material that is compatible with the particulates that are currently being crushed, thereby providing the crushing system with extreme versatility and an ability to crush many different types of materials.

The well can flow the particulate from the well to the ports. In one or more embodiments, the particulate can flow from the well to the ports at a high velocity, forming a high velocity particulate. For example, the particulate can flow from the well to the ports at a velocity of up to five hundred and fifty feet per second.

The ultrafine material crusher system can include at least one abrasion resistant sleeve or a plurality of abrasion resistant sleeves. An abrasion resistant sleeve can be disposed in each of the ports. In one or more embodiments, each abrasion resistant sleeve can be inserted into one of the ports. Each abrasion resistant sleeve can have a hardness rating of at least eight on the MOHS hardness scale.

Each of the abrasion resistant sleeves can pass the particulate from the rotating plate and out of the centrifugal assembly. In one or more embodiments, the abrasion resistant sleeves can be about ⅛ of an inch thick. The abrasion resistant sleeve can be fragile and can have an inner diameter from about one and one half inches to about four inches. Each abrasion resistant sleeve can be a ceramic sleeve.

In one or more embodiments an abrasion and impact resistant coating can be disposed on the rotating plate. The abrasion and impact resistant coating can be a tungsten carbide coating.

An edge liner can be attached to the plate perimeter. The edge liner can be metal or ceramic.

The centrifugal assembly can rotate to produce a particulate velocity from about seventy five feet per second to about five hundred fifty feet per second.

In one or more embodiments the rotating plate can include a first circular plate and at least one radial segment or a plurality of radial segments disposed on the first circular plate. The radial segments can be replaceable.

The rotating plate can include a second circular plate that can be affixed or otherwise disposed over the radial segments and the first circular plate.

A fastening means can connect the first circular plate to the second circular plate and can securely contain the radial segments between the first circular plate and the second circular plate. The fastener can be a thru bolt or another fastener.

The first circular plate and the second circular plate can each be one inch thick and can be formed of a carbon steel plate. Each radial segment can be formed of ceramic or graphite.

The ultrafine material crusher system can include a locking means that can hold the abrasion resistant sleeves in the ports.

The locking means can include a counter bore, a locking ring, a plurality of grooved fingers, an adhesive, clips, or pins.

The ultrafine material crusher system can include a motor that can be in mechanical communication or otherwise in communication with the centrifugal assembly. The motor can be connected to the centrifugal assembly. The motor can actuate, accelerate, decelerate, deactuate or otherwise control the rotating plate. The motor can be a direct drive motor. When accelerating, the rotating plate can impart force upon the particulate to form a high velocity particulate and to crush the particulate to form a fine particulate.

The ultrafine material crusher system can include a variable frequency drive that can be in electrical communication or otherwise in communication with the motor. The variable frequency drive can be connected to the motor. The variable frequency drive can optimize a rotation speed of the rotating plate. By optimizing the rotation speed of the rotating plate, the variable frequency drive can prevent over-crushing of the high velocity particulate and can prevent or reduce the production of waste product. For example, using the variable frequency drive, the ultrafine material crusher system can produce a fine particulate material without producing over-crushed waste product material.

An example of a variable frequency drive usable in the system can include a Toshiba H9 variable frequency drive. An example of a motor usable in the system can include a Toshiba EQPIII premium efficient C face or D face motor.

Rotation of the rotating plate can be performed using the motor connected to the variable frequency drive. The rotating plate can rotate up to four thousand two hundred revolutions per minute, 4200 rpm, to form a high velocity particulate.

The crushing system can allow egress of the high velocity particulate from the rotating plate through the abrasion resistant sleeves impacting a stationary anvil to form a fine particulate. The high velocity particulate can have a particulate velocity of up to five hundred fifty feet per second.

The variable frequency drive can be a programmable variable frequency drive.

The ultrafine material crusher system can include a client device that can be in communication with the variable frequency drive through a network, enabling for operation of the ultrafine material crusher system from a remote location using the client device to control the variable frequency drive.

The variable frequency drive can be in communication with other variable frequency drives of other crusher systems. A plurality of crusher systems can be synchronously and simultaneously controlled such as by using the client device communicating with each of the variable frequency drives through the network.

The ultrafine material crusher system can include an anvil ring assembly. The anvil ring assembly can include an anvil ring and at least one anvil holder or a plurality of anvil holders.

The anvil holders can be disposed around the anvil ring. In one or more embodiments, the anvil holders can be disposed equidistantly around the anvil ring.

The anvil ring assembly can include at least one anvil or a plurality of anvils. The anvils can be removable anvils. Each anvil can have a face, or an anvil face. Each anvil can be disposed in an anvil holder. The ultrafine material crusher system can include from six to fifty anvils disposed on the anvil ring. The anvils can be completely replaceable.

In one or more embodiments, all of the anvil faces can have identical angles of impact. The angles of impact of the anvil faces can range from about sixty degrees to about ninety degrees.

In operation of the system, each anvil face can be impacted by the high velocity particulate at an angle.

In one or more embodiments, the anvil ring assembly can act or function similar to a turbine. With one or more embodiments being a closed system, a natural downdraft can be formed.

The downdraft can carry the high velocity particulate from the anvil faces downward to the outlet in the body. The crushed high velocity particulate can flow from the outlet of the body as a fine particulate.

The anvil ring assembly can include a lifting means that can enable the anvil ring assembly to establish or be disposed at multiple different elevations for accepting the high velocity particulate, thereby allowing for equal wear on the full face of each of the anvils.

The lifting means can include pad eyes on the anvil ring assembly for lifting. For example, the lifting means can include at least two pad eyes on the anvil ring assembly.

The ultrafine material crusher system can include an anvil ring assembly support lug for securing the anvil ring to the body.

In one or more embodiments each of the anvils can include or can be formed of: ceramic, boron, boron nitrides, tungsten, tungsten carbides, alumina, zirconium, silicon carbide, other carbides, or other metals.

The ultrafine material crusher system can include a gas purge system. The gas purge system can use a gas to pressurize a shaft bearing on the motor, enabling continuous use of the system. In one or more embodiments the gas can be air, nitrogen, an inert gas, a mixture of gasses, or another gas.

One or more embodiments of the ultrafine material crusher system can include a flywheel assembly. The flywheel assembly can be engaged with the motor, thereby allowing for pressurization of a bearing area of the motor and preventing entry of dust into the motor.

The ultrafine material crusher system can include a motor mount plate. The motor mount plate can connect the motor to the body, thereby allowing for pressurization of the motor bearings and preventing entry of dust. The motor mount plate can allow for quick replacement of the motor.

The ultrafine material crusher system can include a mounting ring that can be attached to the body. The mounting ring can support the motor mount plate, enabling for quick removal of the motor.

In one or more embodiments, a motor ventilation tunnel can be formed in the body for containing the motor and providing clean air to the motor during formation of the high velocity particulate. The motor ventilation tunnel can be disposed at an angle from the feed tube, such as a ninety degree angle.

In one or more embodiments a liner can be disposed on the body between the anvil ring assembly and the body.

The ultrafine material crusher system can include at least one support block or a plurality of support blocks. Each support block can be disposed between the liner and the anvil support ring for realigning and supporting the anvils. Each support block can include different support levels for realigning and supporting the anvil ring assembly to allow for even wear of the anvils. For example, each support block can include at least two different support levels.

The ultrafine material crusher system can include a hydraulic lift assembly. The hydraulic lift assembly can include a hydraulic cylinder that can be connected to or can engage with the body, such as an edge of the crusher body.

The hydraulic lift assembly can include a yoke that can be connected to or engaged with the hydraulic cylinder. The yoke can engage the lid, thereby allowing the lid to be opened or closed.

In one or more embodiments, the centrifugal assembly can include a top that can be disposed over the ports. The lid can include an opening that can allow the particulate flow to enter the well.

In one or more embodiments, the ultrafine material crusher system can include a feed hopper that can receive the particulate and can flow the particulate into the feed tube. The feed hopper can be a vibratory feeder, a volumetric screw, a rotary air lock or another feed hopper. The feed hopper can allow for more particulate to enter into the feed tube.

In one or more embodiments, the feed tube can include nozzle, or a feed nozzle, that can condense the particulate into a condensed column for flowing into the well. The feed nozzle can provide for more even and substantially equivalent distribution of particulate from the feed tube to the ports of the centrifugal assembly, enabling even loading of particulates into the centrifugal assembly.

In one or more embodiments the particulate received and crushed can at least partially include a colorant. The ultrafine material crusher system can receive and crush the particulate including the colorant to form a fine particulate of the colorant.

The colorant can be a pigment, a cyan pigment, a magenta pigment, a yellow pigment, carbon black, or another colorant.

In one or more embodiments the particulate received and crushed can include a catalyst, wherein the catalyst can include an element and/or a compound. The ultrafine material crusher system can receive and crush the particulate including the catalyst to form a fine particulate of the element and/or the compound. For example, the ultrafine material crusher system can be used to reclaim metals, earth metals, periodic table Group IIIB elements, other elements, or other compounds from catalysts.

For example, the elements recoverable from catalysts can include platinum, rhodium, ruthenium, gallium, titanium, or palladium.

The compounds recoverable using the ultrafine material crusher system can include iron ore, chrome ore, magnetite, or combinations thereof.

In one or more embodiments the particulate received and crushed can include a material that at least partially includes silica or a silica containing compound, such as glass. The ultrafine material crusher system can receive and crush the particulate including the silica to form an ultrafine silica powder or an ultrafine silica flour. The ultrafine silica flour recovered using the ultrafine material crusher system can be used as fillers and enhancers in many products such as paints, toothpaste, carpet backing, and other products, whereas coarser fractions of crushed glass can be used to make a special glass bead for the production of reflective surfaces on roadways.

Below are illustrative examples of materials that can be crushed using the ultrafine material crusher system along with various operation parameters.

Example 1

The ultrafine material crusher system can be used to grind minus ⅝" cullet glass. The ⅝" cullet glass can be used to produce a minus 20 mesh/plus 70 mesh product.

In operation, an open top rotor can be used and can be turned at one thousand five hundred revolutions per minute, 1500 RPM, using a sixty horse power motor.

The ultrafine material crusher system can thereby make thirty tons of fine particulate (finished product) per hour, 30 TPH, in a closed loop system with a two deck scalping screen.

The crushed material from the discharge outlet of the ultrafine material crusher system can be conveyed mechanically or pneumatically to a scalping screen system where over-sized (scalped) material can be conveyed back to the crusher inlet or to the feed hopper. The desired correctly sized crushed material can be collected in the screening unit fines hopper and can be sent on to storage or to further processing in another system.

The fine particulate produced can include 10 percent of minus 20 M or "mesh" particulate, 30 percent of minus 30 mesh particulate, 45 percent of minus 50 mesh particulate, and 10 percent of equal to or minus 70 mesh particulate.

Example 2

The ultrafine material crusher system can be used to grind magnetite of a size of minus 2 mm (10 Mesh).

A raw material can be fed into a 26" ceramic tube lined 12 port rotor. Fifteen tons per hour of ground magnetite can be made using a forty horsepower motor.

The typical raw material can include no particulates being 325 M, ninety four percent of the total particulates of the raw material can be larger than 200 M, seventy five percent can be larger than 70 M, forty eight percent can be larger than 40 M, and 20 percent can be larger than 20 M.

The material can be passed through the ultrafine material crusher system four times sequentially at three thousand revolutions per minute resulting in a finished product. One hundred percent of the finished product can be less than 70 M, sixty five percent of the finished product can be less than 200 M, and thirty six percent of the finished product can be less than 325 M.

An air separator can be coupled with the ultrafine material crusher system to remove the proper sized (minus 325 Mesh or 45μ) material with each pass of the raw material through the ultrafine material crusher system. Removal of the fine particulate with each pass can make the crushing of the remainder of the raw material much more efficient.

The air separator can remove other desirable fractions on a multi-deck screening system with the oversize material being re-circulated back through a closed loop material handling system and back to the ultrafine material crusher system.

Example 3

The ultrafine material crusher system can be used to crush minus 2 mm (10 Mesh) glass cullet which can be fed into a 26" ceramic tube lined 12 port rotor. The ultrafine material crusher system can be used to make thirty tons of finished product per hour using a fifty horse power motor.

The raw material can be 98 percent particulates larger than or equal to 400 M or 38μ, 89 percent particulates larger than or equal to 200 M or 75μ, 73 percent particulates larger than or equal to 100 M or 150μ, 52 percent particulates larger than 50 M or 30μ, 20 percent particulates larger than 25 M or 710μ, and 4 percent particulates larger or equal to 10 M or 2 mm.

The raw material can be crushed in a single pass through the ultrafine material crusher system at three thousand revolutions per minute. The finished product can be 98 percent particulate less than 25 M, 75 percent particulate less than 50 M, 49 percent particulate less than 100 M, 25 percent particulate less than 200 M, and 5 percent particulate less than 400 Mesh.

Example 4

The ultrafine material crusher system can be used to crush calcined alumina of minus 70 Mesh which can be fed into a 26" ceramic tube lined 12 port rotor to make twenty five Tons of finished product per hour using a forty horse power motor.

The raw material to be crushed can be 96 percent particulates larger than 325 M or 38μ, 72 percent particulates larger than or equal to 200 M, 6 percent particulates larger than 100 M, and 1 percent particulates larger than or equal to 70 M.

The raw material can be crushed in a single pass through the ultrafine material crusher system at three thousand revolutions per minute.

The resulting material, or finished product, can be 100 percent particulate of minus 100 M, 68 percent particulate of smaller or equal to 200 M, and 21 percent particulate of smaller or equal to 400 M.

The ultrafine material crusher system can de-agglomerate clumped calcined alumina discs that can be used as a grinding media without breaking the individual particles of calcined alumina any more than necessary.

Turning now to the Figures, FIG. 1 shows an embodiment of a crusher system 6.

The crusher system 6 can have a crusher body 1 with an openable lid 2 and an outlet or motor ventilation tunnel 44. The openable lid 2 can have an abrasion resistant lid liner 3.

A feed tube 7 can be disposed through the openable lid 2 for receiving particulate 46 and forming a particulate flow.

The crusher system 6 can have a centrifugal assembly 8 disposed within the crusher body 1. The centrifugal assembly 8, which will be described in more detail in later Figures, can be in fluid communication with the feed tube 7.

A well 9 can be disposed on a rotating circular plate (not shown in this Figure) of the centrifugal assembly 8 for receiving the particulate 46 from the feed tube 7 and then flowing the particulate 46 to a plurality of ports (not shown in this Figure) using a centrifugal force produced by spinning the rotating circular plate.

A motor 14 can be connected to the centrifugal assembly 8 for controlling the rotating circular plate.

The crusher system 6 can have a hydraulic lift assembly 55 that can include a hydraulic cylinder 15 connected to an edge of the crusher body 1 on the openable lid 2 using a yoke 4.

Radial support bars 53 can project from an inlet sleeve 51.

An anchor plate 50 can support the feed tube 7 and the inlet sleeve 51. The anchor plate 50 can surround the feed tube 7 for dust control. A boot 52 can be disposed around the inlet sleeve 51 for dust control.

Lid fastening wedges, 5*a*, 5*b*, and 5*c* can be used for fastening the openable lid 2. More or less lid fastening wedges can be used.

A feed tube adjustment assembly 47 can surround the feed tube 7 and can be used to increase or decrease the length of penetration of the feed tube 7 through the openable lid 2 and into the crusher body 1.

A flywheel assembly 11 can engage the motor 14, allowing for pressurization of the motor bearing area and preventing the entry of dust.

A motor mount plate 12 can connect the motor 14 to the crusher body 1.

A mounting ring 13 can be attached to the crusher body 1 for supporting the motor mount plate 12 enabling for quick removal of the motor 14.

The crusher system 6 can include a gas purge system 16 for pressurizing a shaft bearing on the motor 14 thereby enabling for continuous use of the crusher system 6.

A liner 37 can be used on the crusher body 1 between an anvil ring assembly (not shown in this Figure) and the crusher body 1. The liner 37 can be made from abrasion resistant plate AR500 or Chromium carbide overlay plate.

The outlet or motor ventilation tunnel 44 can be formed in the crusher body 1 and can include a semi-circular top and two straight sidewalls, outlet or motor ventilation tunnel walls 56*a* and 56*b*, which can start at the motor 14, such as at a leads conductor box, and can extend down to a base of the crusher system 6. The outlet or motor ventilation tunnel 44 can allow for good air flow around and within the crusher system 6.

A feed nozzle 17 can be in fluid communication with the feed tube 7.

Figure 2:
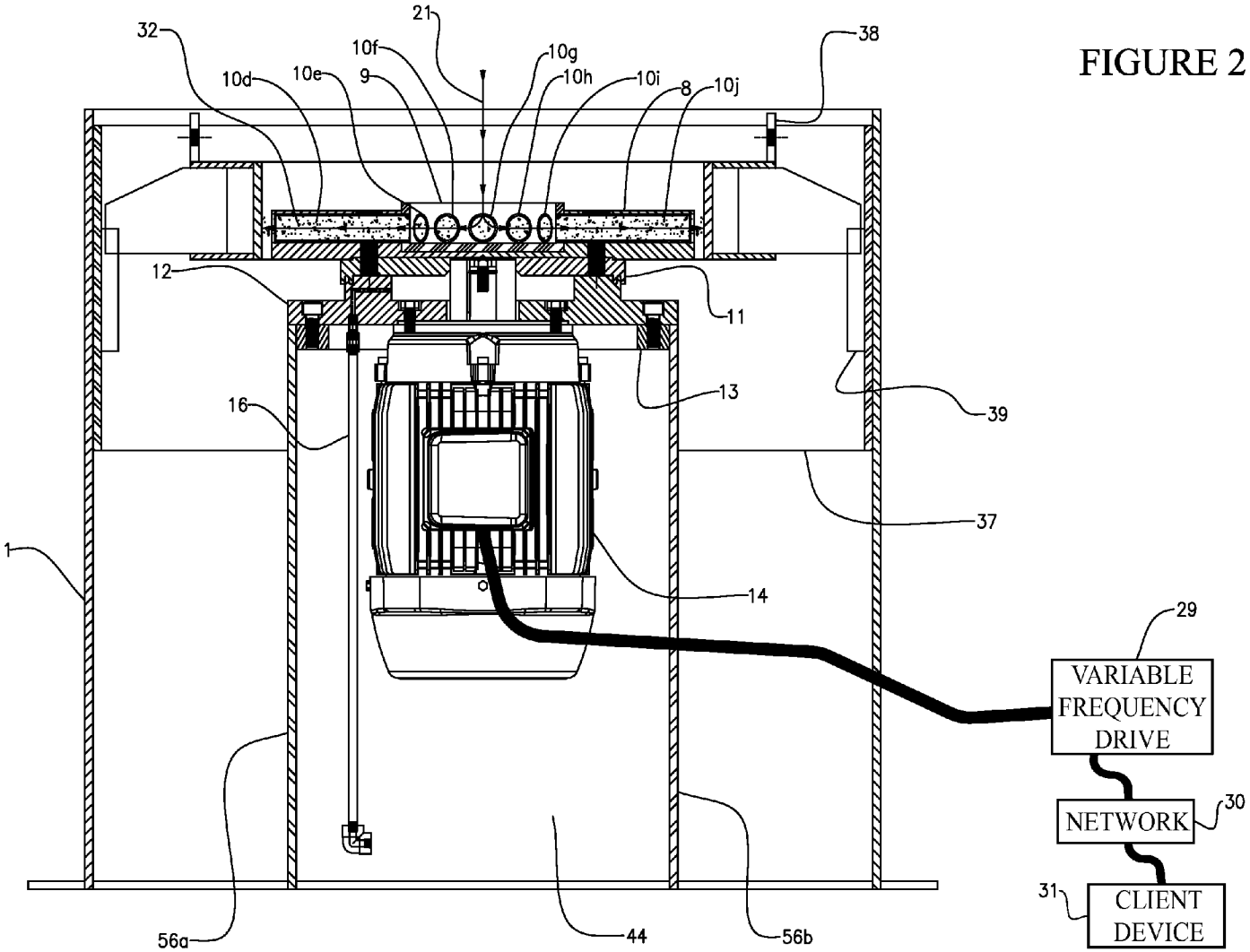
FIG. 2 depicts a section of the ultrafine material crusher system showing feed components and drive components.

FIG. 2 shows the drive components and a variable frequency drive 29 connected to the motor 14 and a network 30. The network 30 can be in communication with a client device 31.

The motor 14 can be disposed under the mounting ring 13 in the crusher body 1. The gas purge system 16 can be disposed through the mounting ring 13. The motor mount plate 12 can be disposed over the mounting ring 13.

The flywheel assembly 11 can be mounted over the motor mount plate 12.

Support blocks 39 can support and allow for vertical adjustment to the anvil ring assembly.

The lifting means 38, the high velocity particulate 32, the liner 37, the outlet or motor ventilation tunnel 44, the outlet or motor ventilation tunnel walls 56*a* and 56*b* and a plurality of abrasion resistant sleeves 10*d*-10*j* can be seen.

A particulate flow 21 can be seen flowing into the well 9 of the centrifugal assembly 8.

Figure 3:
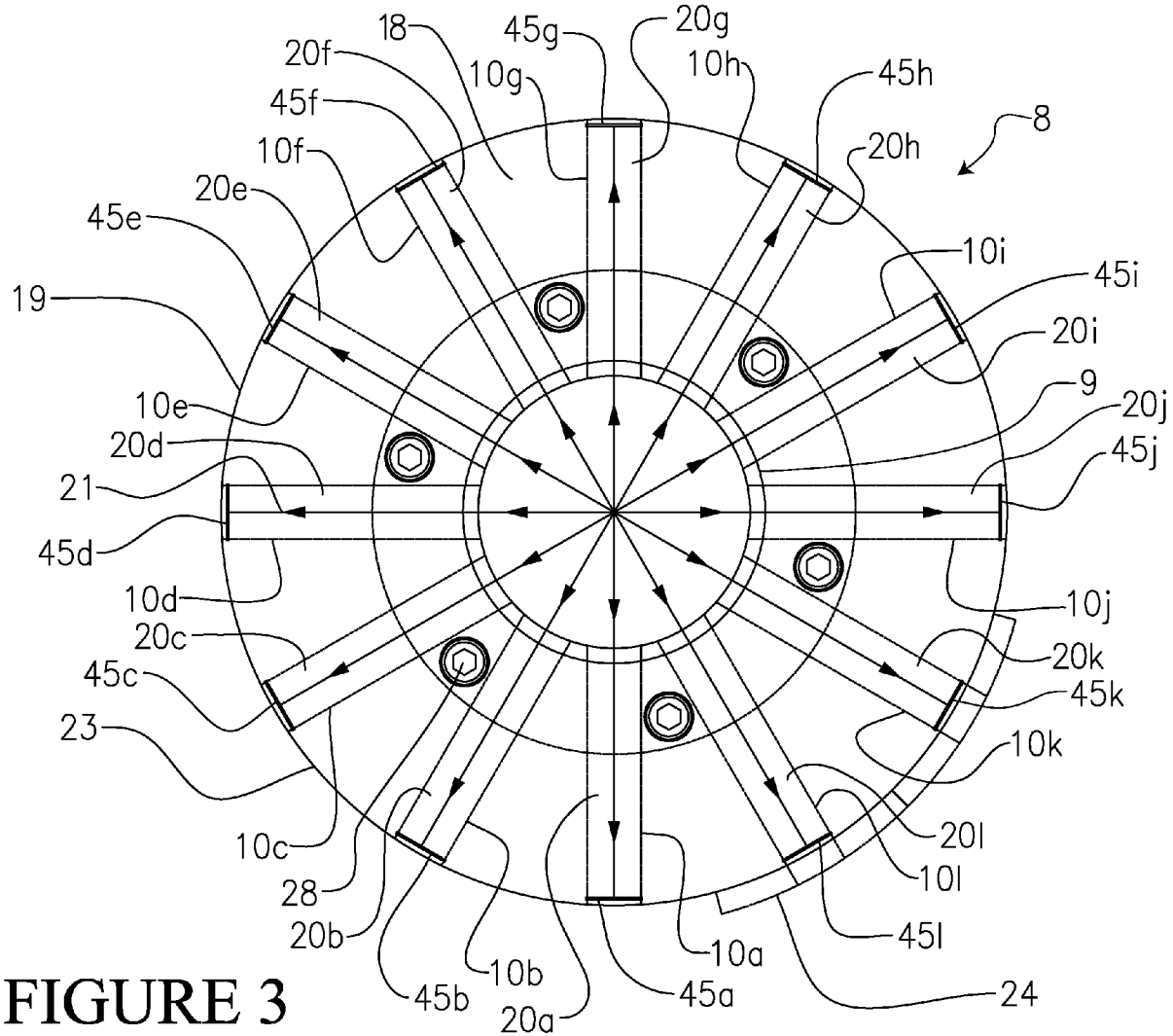
FIG. 3 depicts a top view of a table according to one or more embodiments.

FIG. 3 depicts a top view of a table according to one or more embodiments.

FIG. 3 shows the centrifugal assembly 8 having a rotating circular plate 18 having a plate perimeter 19.

A plurality of ports 20*a*-20*l* are shown. The plurality of abrasion resistant sleeves 10*a*-10*l* can be disposed within each of the plurality of ports. The plurality of abrasion resistant sleeves can pass the particulate flow 21 from the rotating circular plate 18 and out of the centrifugal assembly 8.

An abrasion resistant coating 23 can be disposed on the rotating circular plate 18. An edge liner 24 can be disposed on the rotating circular plate 18.

Locking means 45*a*-45*l* can hold each abrasion resistant sleeve within each of the ports.

A fastening means 28 and the well 9 are also depicted.

Figure 4:
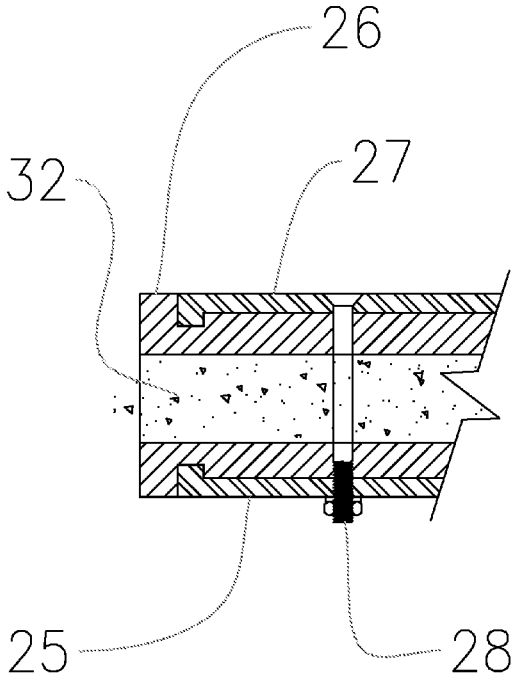
FIG. 4 depicts a schematic view of another table according to one or more embodiments.

FIG. 4 depicts a schematic view of another table according to one or more embodiments.

FIG. 4 shows the high velocity particulate 32 between a first circular plate 25 and a second circular plate 27. Replaceable radial segments 26 and the fastening means 28 are depicted.

The high velocity particulate 32 can be formed by the spinning action of the rotating circular plate.

Figure 5:
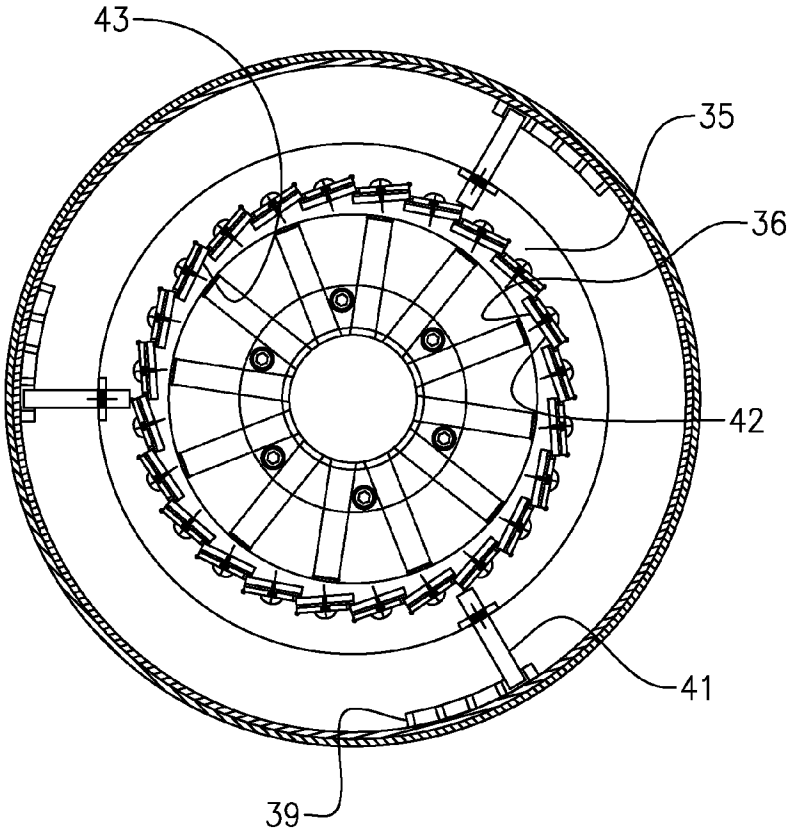
FIG. 5 depicts a plan view of a crusher table assembly with a shallow angle anvil ring assembly with anvils used to make a fine material product according to one or more embodiments.

FIG. 5 depicts a plan view of a crusher table assembly with a shallow angle anvil ring assembly with anvils used to make a fine material product according to one or more embodiments.

FIG. 5 shows an anvil angle of impact 43, an anvil holder 35, an anvil 36, an anvil face 42, an anvil ring assembly support lug 41, and a support block 39.

Figure 6:
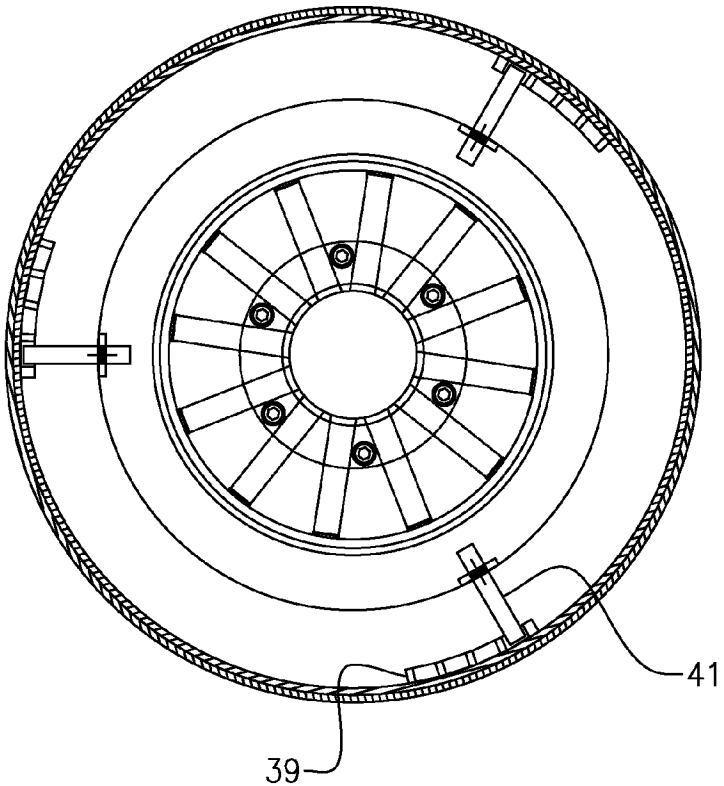
FIG. 6 depicts a plan view of a crusher table assembly with a solid-ring anvil-ring assembly used to make an ultra-fine material product according to one or more embodiments.

FIG. 6 depicts a plan view of a crusher table assembly with a solid-ring anvil-ring assembly used to make an ultra-fine material product according to one or more embodiments.

FIG. 6 shows a support block 39 with the anvil ring assembly support lugs 41.

Figure 7:
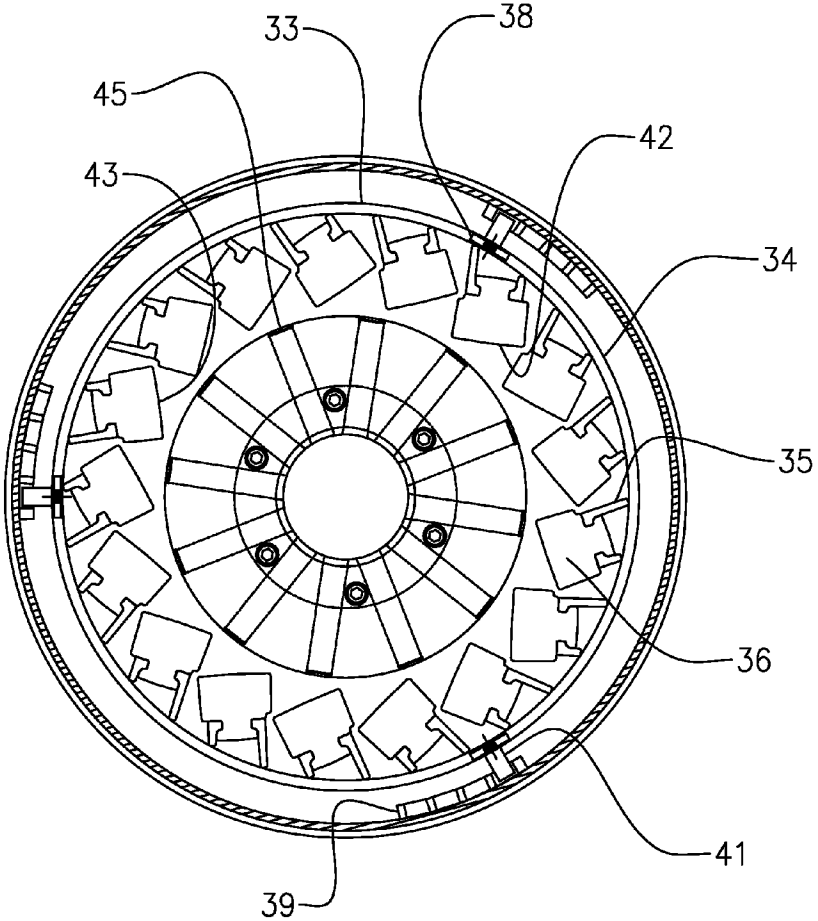
FIG. 7 depicts a plan view of a crusher table assembly with a steeper angle of impact anvil ring assembly with heavy duty anvils used to make a coarse material product, according to one or more embodiments.

FIG. 7 depicts a plan view of a crusher table assembly with a steeper angle of impact anvil ring assembly with heavy duty anvils used to make a coarse material product, according to one or more embodiments.

FIG. 7 shows an anvil ring assembly 33 having an anvil ring 34 with an anvil holder 35 disposed around the anvil ring 34. A plurality of removable and re-installable anvils, such as anvil 36, can be held by the anvil holders, such as anvil holder 35. The anvil 36 can have an anvil face 42.

An anvil ring assembly support lug 41 can secure the anvil ring 34 to the crusher body. The anvil ring assembly support lug 41 can engage the support block 39.

FIG. 7 further shows the anvil angle of impact 43, the locking means 45 and the lifting means 38.

Figure 8:
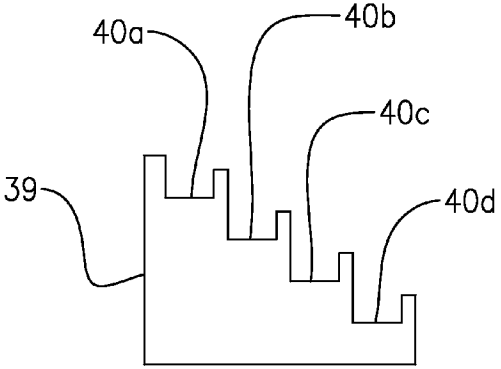
FIG. 8 depicts a stepped anvil ring assembly support blocks according to one or more embodiments.

FIG. 8 shows a profile view of the support block 39 with the support levels 40*a*, 40*b*, 40*c*, and 40*d* having different heights.

Figure 9A:
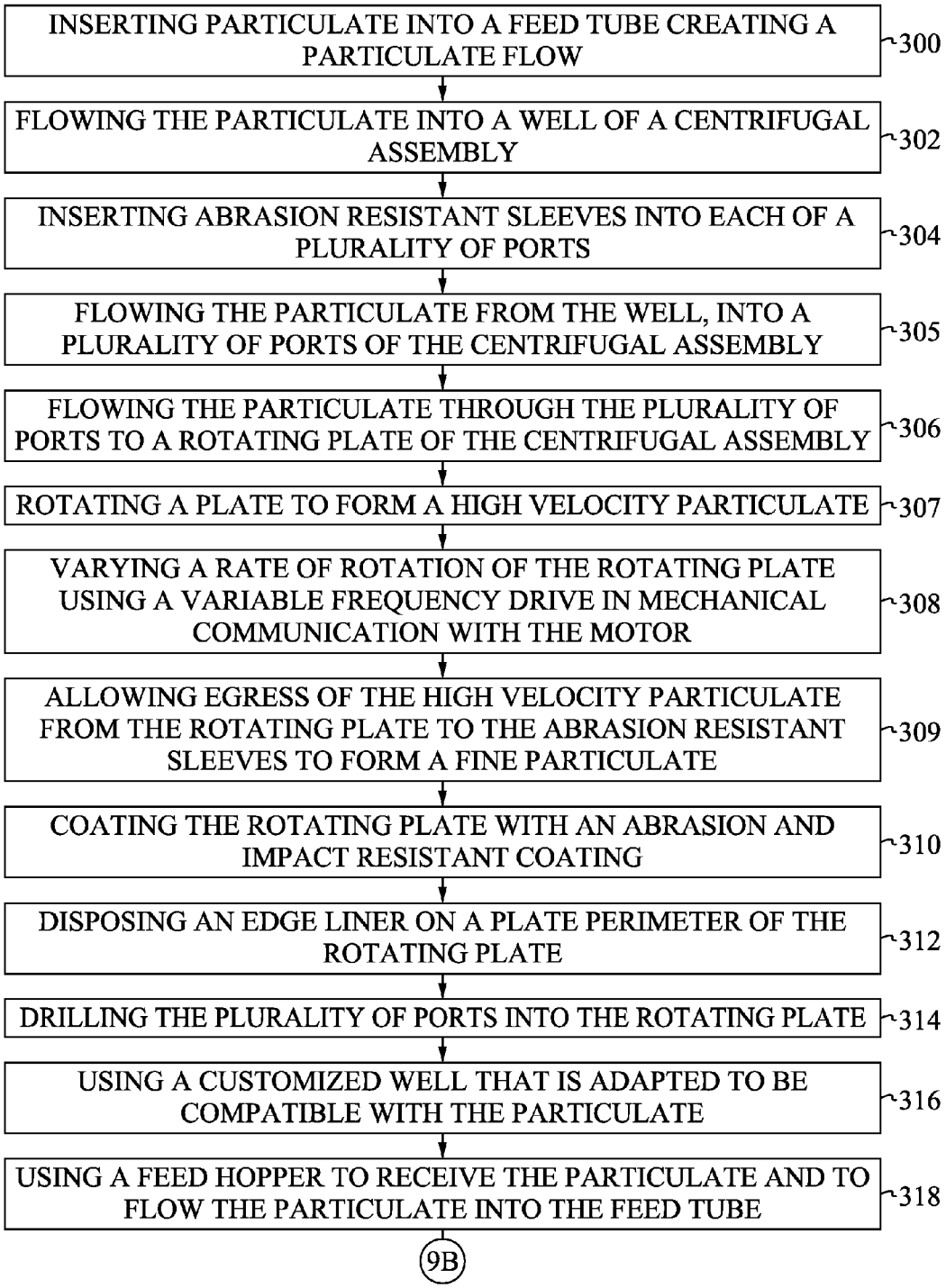
FIGS. 9A-9B depict a flow chart of a method that can be implemented using the system according to one or more embodiments.

FIG. 9A shows an embodiment of a method that can be implemented using the system.

The method includes the step of inserting particulate into a feed tube creating a particulate flow, as is illustrated by box 300.

The method can include flowing the particulate into a well of a centrifugal assembly, as is illustrated by box 302.

The method can include inserting abrasion resistant sleeves into each of a plurality of ports, as is illustrated by box 304.

The method can include flowing the particulate from the well, into a plurality of ports of the centrifugal assembly, as is illustrated by box 305.

The method can include flowing the particulate through the plurality of ports to a rotating plate of the centrifugal assembly, as is illustrated by box 306.

The method can include rotating a plate to form a high velocity particulate, as is illustrated by box 307.

The method can include varying a rate of rotation of the rotating plate using a variable frequency drive in mechanical communication with the motor, as is illustrated by box 308.

The method can include allowing egress of the high velocity particulate from the rotating plate through the abrasion resistant sleeves impacting a stationary anvil to form a fine particulate, as is illustrated by box 309.

The method can include coating the rotating plate with an abrasion and impact resistant coating, as is illustrated by box 310.

The method can include disposing an edge liner on a plate perimeter of the rotating plate, as is illustrated by box 312.

The method can include drilling the plurality of ports into the rotating plate, as is illustrated by box 314.

The method can include using a customized well that is adapted to be compatible with the particulate, as is illustrated by box 316.

The method can include using a feed hopper to receive the particulate and to flow the particulate into the feed tube, as is illustrated by box 318.

Figure 9B:
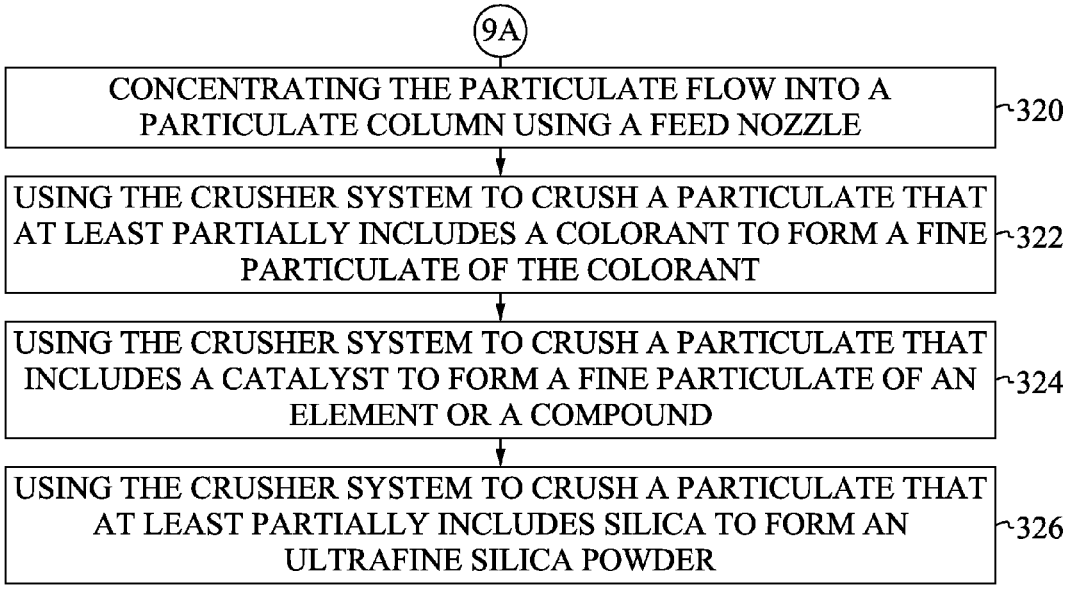

FIG. 9B is a continuation of FIG. 9A.

The method can include concentrating the particulate flow into a particulate column using a feed nozzle, as is illustrated by box 320.

The method can include using the crusher system to crush a particulate that at least partially includes a colorant to form a fine particulate of the colorant, as is illustrated by box 322.

The method can include using the crusher system to crush a particulate that includes a catalyst to form a fine particulate of an element or a compound, as is illustrated by box 324.

The method can include using the crusher system to crush a particulate that at least partially includes silica to form an ultrafine silica powder, as is illustrated by box 326.

Figure 12:
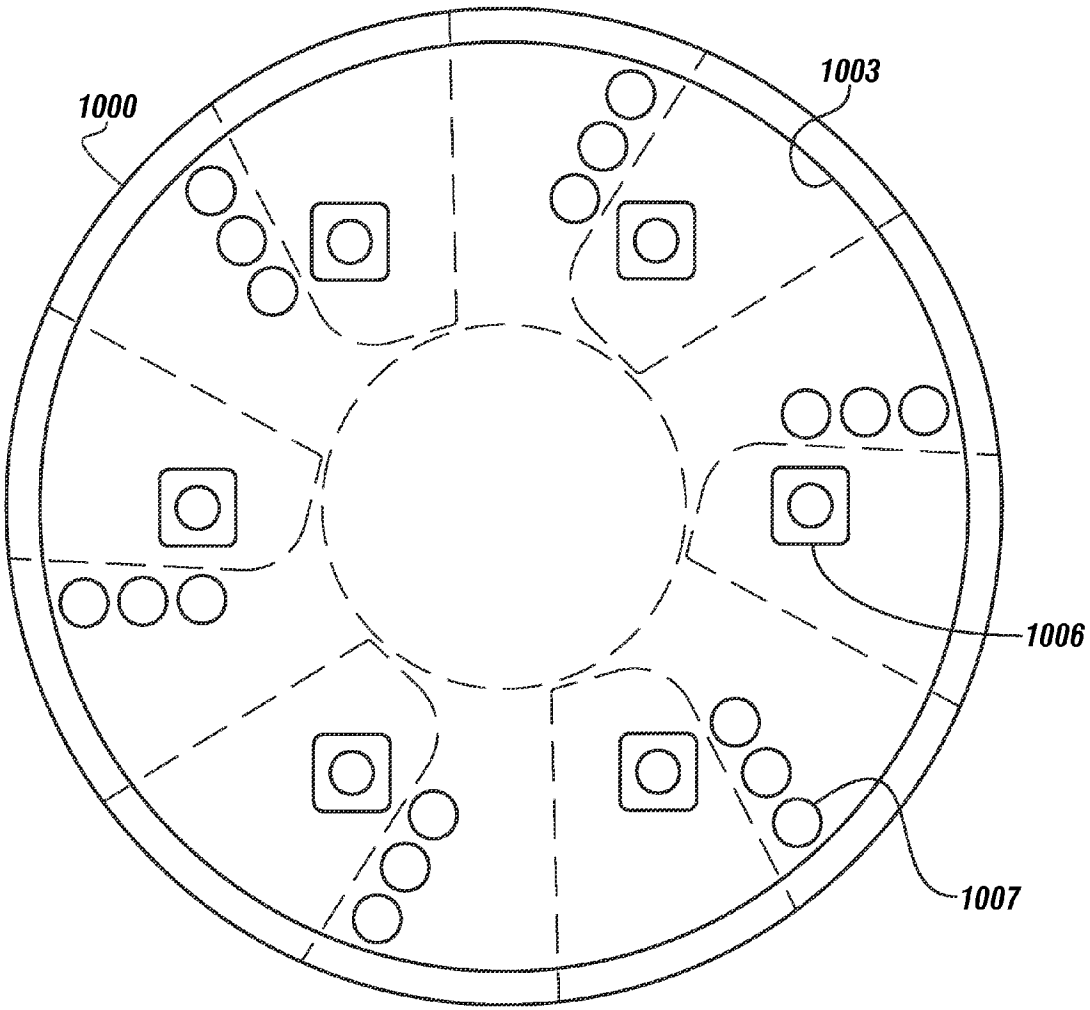
FIG. 12 depicts a bottom view of the table of FIG. 10.

FIG. 10 depicts a top view of another embodiment of a table 1000 according to one or more embodiments. FIG. 11 depicts an elevation view of the table 1000. FIG. 12 depicts a bottom view of the table 1000.

Referring to FIGS. 10, 11, and 12, the table 1000, which can be a monolithic cast table, can include a material feed area 1002 located in a portion thereof. The table can also be referred to as a centrifugal assembly.

The table 1000 can also include one or more recesses 1004 for receiving an impeller shoe (an illustrative impeller shoe is described below in FIG. 13). One or more of the recesses can have an attachment hole 1005. The attachment hole 1005 can receive a fastener for securing an impeller shoe within the recesses 1004.

A raised area 1008 on the top portion of the table 1000 can be configured to divert material onto one or more impeller shoes located in one or more recesses 1004.

The table 1000 can also include a skirt 1003 for protecting a flywheel assembly. The flywheel assembly can be any flywheel. The flywheel assembly can be operatively disposed adjacent the table 1000.

One or more attachment holes 1005 can have a leveling pad 1006 adjacent thereto. The leveling pad 1006 can overlay a portion of the attachment hole 1005 and have a hole formed therethrough that aligns with the attachment hole. One or more leveling pads 1006 can be located within the recesses 1004.

The table 1000 can include one or more balancing weight recesses. 1007. The balancing weight recesses 1007 can be used to receive counter or balancing weights.

Figure 13:
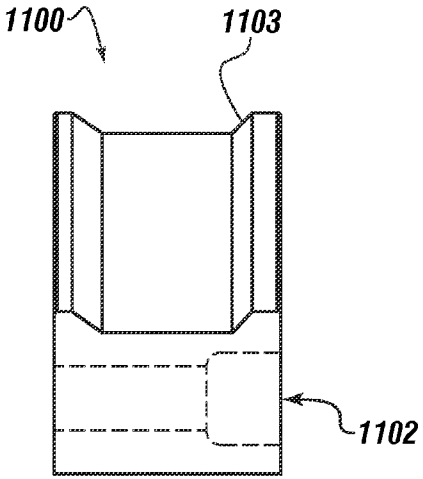
FIG. 13 depicts an impeller shoe for one or more embodiments of the tables disclosed herein according to one or more embodiments.

FIG. 13 depicts an impeller shoe 1100 for one or more embodiments of the tables disclosed herein. For example, one or more of the recesses, described and shown above, can house the impeller shoe 1100.

The impeller shoe 1100 can have an impeller attachment hole 1102. The impeller attachment hole 1102 can align with the attachment hole in the recesses, described above, when the impeller shoe 1100 is disposed within the recesses of the table described herein.

The impeller shoe 1100 can also have material guides 1103.

While these embodiments have been described with emphasis on the embodiments, it should be understood that within the scope of the appended claims, the embodiments might be practiced other than as specifically described herein.

What is claimed is:

1. An ultrafine material crusher system comprising:

a. a crusher body with an openable lid and an outlet;

b. a feed tube disposed through the openable lid for receiving particulate and forming a particulate flow;

c. a rotating centrifugal multiport assembly disposed within the crusher body and in fluid communication with the feed tube, wherein the rotating centrifugal multiport assembly comprises:

(i) a rotating circular plate with a plate perimeter;

(ii) a plurality of ports equidistantly located along the plate perimeter;

(iii) a well centrally disposed in the rotating circulate plate for receiving the particulate flow from the feed tube at an angle between eighty degrees and one hundred degrees and then flowing the particulate flow to the plurality of ports at a velocity of up to five hundred feet per second;

(iv) a plurality of abrasion resistant sleeves disposed in each of the plurality of ports, wherein each abrasion resistant sleeve has a hardness rating of at least eight on the MOHS hardness scale; and (v) a locking means for holding the plurality of abrasion resistant sleeves in each of the plurality of ports;

d. a direct drive motor connected to the rotating centrifugal multiport assembly for accelerating, running, decelerating and stopping the rotating circular plate, wherein the rotating circular plate forms a high velocity particulate while it accelerates and runs, and wherein each of the abrasion resistant sleeves passes the high velocity particulate from the rotating circular plate out of the rotating centrifugal multiport assembly;

e. a variable frequency drive connected to the direct drive motor for optimizing rotation speed of the rotating circular plate, preventing over crushing of particles in the high velocity particulate, and preventing creation of waste product;

f. an anvil ring assembly comprising:

(i) an anvil ring;

(ii) a plurality of anvil holders disposed equidistantly around the anvil ring; and (iii) a plurality of removable anvils each having an anvil face, wherein each removable anvil is disposed in one of the anvil holders allowing each anvil face to be impacted at an angle by the high velocity particulate, and wherein a downdraft carries the high velocity particulate from the anvil faces downward to the outlet in the crusher body;

g. a gas purge system for pressurizing a shaft bearing on the direct drive motor enabling continuous use of the system.

2. The system of claim 1, wherein the feed tube is connected to the crusher body with a feed tube adjustment assembly.

3. The system of claim 1, further comprising a flywheel assembly engaged with the direct drive motor, allowing for pressurization of a direct drive motor bearing area thereby preventing entry of dust into the direct drive motor.

4. The system of claim 3, further comprising a motor mount plate connecting the direct drive motor to the crusher body, allowing for pressurization of the motor bearings thereby preventing entry of dust and further allowing for quick replacement of the direct drive motor.

5. The system of claim 4, further comprising a mounting ring attached to the crusher body and supporting the motor mount plate, enabling for quick removable of the direct drive motor.

6. The system of claim 1, wherein the locking means comprises: a counter bore, a locking ring, a plurality of grooved fingers, an adhesive, clips, or pins.

7. The system of claim 1, further comprising a motor ventilation tunnel formed in the crusher body for containing the direct drive motor and providing clean air to the direct drive motor during formation of the high velocity particulate.

8. The system of claim 1, further comprising a liner disposed on the crusher body between the anvil ring assembly and the crusher body.

9. The system of claim 1, wherein the anvil ring assembly further comprises a lifting means enabling the anvil ring assembly to be disposed at multiple different elevations for accepting the high velocity particulate, thereby allowing for equal wear on each of the plurality of removable anvils.

10. The system of claim 1, further comprising a plurality of support blocks disposed between the liner and an anvil support ring for realigning and supporting the removable anvils of the anvil ring assembly, wherein the support blocks each comprise at least two different support levels for realigning and supporting the anvil ring assembly to allow for even wear of the removable anvils.

11. The system of claim 1, further comprising an anvil ring assembly support lug for securing the anvil ring to the crusher body.

12. The system of claim 1, further comprising a client device in communication with a network, wherein the variable frequency drive is in communication with the network, enabling operation of the system from a remote location.

13. The system of claim 12, wherein the variable frequency drive is in communication with other variable frequency drives of other ultrafine material crusher systems, allowing for synchronous and simultaneous operation of multiple ultrafine material crusher systems.

14. The system of claim 1, wherein the openable lid further comprises:

a. an anchor plate surrounding and supporting the feed tube;

b. an inlet sleeve surrounding the feed tube for providing dust control;

c. a boot disposed around the inlet sleeve for providing dust control; and d. a plurality of radial support bars projecting from the inlet sleeve for preventing the openable lid from separating from the crusher body, wherein the plurality of radial support bars provide structural support to the openable lid for supporting the feed tube, and wherein the plurality of radial support bars provide strength to the openable lid to contain flying debris and metal within an inside of the crusher body upon a mechanical failure.

15. The system of claim 1, further comprising a hydraulic lifting assembly comprising:

a. a hydraulic cylinder connected to an edge of the crusher body; and b. a yoke connected to the hydraulic cylinder for engaging the openable lid, thereby allowing the openable lid to be opened or closed.

16. The system of claim 1, wherein the feed tube further comprises a feed nozzle for condensing the particulate into a column.

17. The system of claim 1, further comprising an edge liner attached to the plate perimeter of the rotating circular plate.

18. The system of claim 1, wherein the rotating centrifugal multiport assembly rotates to create a particulate velocity from seventy five feet per second to five hundred fifty feet per second.

19. The system of claim 1, wherein the rotating circulate plate comprises:

a. a first circular plate;

b. a plurality of replaceable radial segments disposed on the first circular plate;

c. a second circular plate affixed over the plurality of replaceable radial segments and the first circular plate; and d. a fastening means for connecting the first circular plate to the second circular plate and securely containing the plurality of replaceable radial segments between the first circular plate and the second circular plate.

* * * * *